US009953536B1

(12) United States Patent
Kerr

(10) Patent No.: US 9,953,536 B1
(45) Date of Patent: Apr. 24, 2018

(54) ACCIDENT PRONE LOCATION NOTIFICATION SYSTEM AND METHOD

(71) Applicant: Nationwide Mutual Insurance Company, Columbus, OH (US)

(72) Inventor: Ronald Stewart Kerr, Dublin, OH (US)

(73) Assignee: Nationwide Mutual Insurance Company, Columbus, OH (US)

( * ) Notice: Subject to any disclaimer, the term of this patent is extended or adjusted under 35 U.S.C. 154(b) by 0 days.

(21) Appl. No.: 14/884,954

(22) Filed: Oct. 16, 2015

Related U.S. Application Data

(63) Continuation of application No. 13/611,343, filed on Sep. 12, 2012, now Pat. No. 9,196,159, which is a continuation of application No. 12/169,108, filed on Jul. 8, 2008, now Pat. No. 8,289,187.

(51) Int. Cl.
*G08G 1/0962* (2006.01)
*G08G 1/16* (2006.01)
*G08G 1/0967* (2006.01)

(52) U.S. Cl.
CPC ..... *G08G 1/166* (2013.01); *G08G 1/0967* (2013.01)

(58) Field of Classification Search
CPC ..... G08G 1/09; G08G 1/093; G08G 1/0962; G08G 1/0967; G08G 1/207; G08G 1/0969; G08G 1/096855; G08G 1/0968; G08G 1/096716
See application file for complete search history.

(56) References Cited

U.S. PATENT DOCUMENTS 6,182,010 B1 1/2001 Berstis
6,356,812 B1 * 3/2002 Cragun ..... B60K 35/00 340/990
6,856,902 B1 * 2/2005 Mitchem ..... G01C 21/3697 340/934
6,904,362 B2 6/2005 Nakashima et al.
7,194,347 B2 3/2007 Harumoto et al.
8,606,512 B1 * 12/2013 Bogovich ..... G06Q 40/08 340/995.28
2002/0188402 A1 * 12/2002 Huang ..... G01C 21/3667 701/469
2004/0128063 A1 * 7/2004 Suzuki ..... G01C 21/3697 701/96

(Continued)

FOREIGN PATENT DOCUMENTS

JP 2005283395 * 10/2005

*Primary Examiner* — Hongmin Fan
(74) *Attorney, Agent, or Firm* — Morgan, Lewis & Bockius LLP

(57) ABSTRACT

A method includes maintaining vehicle accident occurrence information, wherein the vehicle accident occurrence information includes accident location information, accident occurrence date information, and accident occurrence time information and identifying, based at least in part on the accident location information, one or more accident-prone locations. When a vehicle enters an area comprising one of the accident-prone locations, a notification is made that the vehicle has entered the area comprising one of the accident-prone locations. In addition, in response to a query, a visual representation of one of the accident-prone locations is displayed, along with accident occurrence date information and accident occurrence time information associated with the accident-prone location.

6 Claims, 7 Drawing Sheets

(56) References Cited

U.S. PATENT DOCUMENTS

| | | | | |
|---|---|---|---|---|
| 2004/0130463 | A1* | 7/2004 | Bloomquist ..... | G08G 1/096716 340/907 |
| 2004/0267455 | A1* | 12/2004 | Hatano ..... | G01C 21/3461 702/2 |
| 2007/0027583 | A1* | 2/2007 | Tamir ..... | G06Q 30/0283 701/1 |
| 2007/0268685 | A1 | 11/2007 | Fossier et al. | |
| 2008/0174451 | A1 | 7/2008 | Harrington et al. | |
| 2008/0252487 | A1* | 10/2008 | McClellan ..... | G01S 5/0027 340/936 |

* cited by examiner

ACCIDENT PRONE LOCATION NOTIFICATION SYSTEM AND METHOD

CROSS-REFERENCE TO RELATED APPLICATIONS

The application is a continuation of U.S. patent application Ser. No. 13/611,343, filed Sep. 12, 2012, which is a continuation of U.S. patent application Ser. No. 12/169,108, filed Jul. 8, 2008, now U.S. Pat. No. 8,289,187, the contents of which are hereby incorporated by reference in their entirety.

BACKGROUND OF THE INVENTION

Field of the Invention

The present invention relates to a system and method for identifying accident-prone locations, and more particularly to a system and method for identifying accident prone-locations to be displayed on a graphical user interface or to be used to notify consumers.

Discussion of the Related Art

Various types of mapping software and systems exist that provide maps and driving directions over communications networks, such as the Internet. However, these systems and software do not identify accident hot spots (i.e., accident-prone locations). Further, these systems and software do not notify users of the locations of such accident-prone locations.

Thus, there remains a need for a system and method for notifying users, particularly drivers, of accident-prone locations.

SUMMARY OF THE INVENTION

Accordingly, the present invention is directed to a method and system for accident-prone location notification that substantially obviates one or more problems due to limitations and disadvantages of the related art.

An object of the present invention is to provide a system and method for making notifications of accident-prone locations.

Another object of the present invention is to provide a system and method for encouraging cautious or defensive driving, thus decreasing the number and/or severity of vehicle accidents.

And yet a further object of the present invention is to decrease the number and/or severity of insurance claims through the notification of accident-prone locations.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method includes maintaining vehicle accident occurrence information. The accident occurrence information includes accident location information. Based at least in part on the accident location information, one or more accident-prone locations are identified. When a vehicle enters an area that includes one of the accident-prone locations, a notification is made that the vehicle has entered such an area.

In another aspect, the system includes a database that maintains vehicle accident occurrence information that includes accident location information; a processor that identifies one or more accident-prone locations based, at least in part, on the accident location information; and a delivery component comprising a global positioning system that notifies a driver that the driver has entered an area that includes an accident-prone area when the driver enters such an area.

In yet another aspect, the method includes maintaining vehicle accident occurrence information, wherein the vehicle accident occurrence information comprises accident location information, accident occurrence date information, and accident occurrence time information.

Based at least in part on the accident location information, one or more accident-prone locations are identified. In response to a query, a visual representation of one of the accident-prone locations is displayed, along with accident occurrence date information and accident occurrence time information associated with the accident-prone location.

In another aspect, the accident hot spot notification system includes a database that maintains vehicle accident occurrence information, wherein the vehicle accident occurrence information comprises accident location information, accident occurrence date information, and accident occurrence time information; a processor that identifies one or more accident-prone locations based, at least in part, on the accident location information; and a display component that displays, in response to a query, a visual representation of one of the accident-prone locations, along with accident occurrence date information and accident occurrence time information associated with the accident-prone location.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 1:
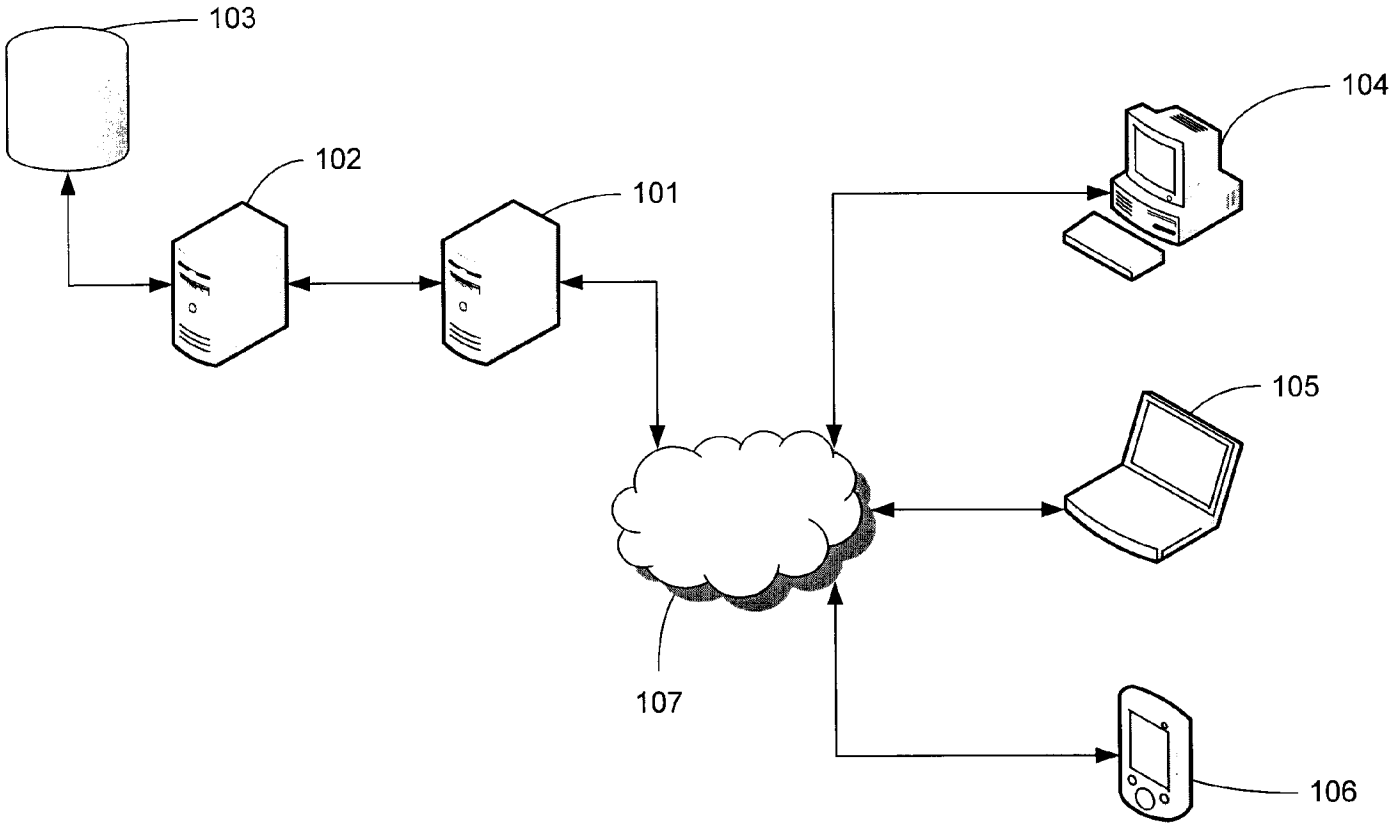
FIG. 1 is a system diagram illustrating an exemplary embodiment of the present invention.

FIG. 1 shows a system diagram illustrating an exemplary embodiment of the present invention for providing notification of accident-prone locations (i.e., accident zones). Accident-prone locations are "hot spots" or zones that historically have a higher frequency of accidents. By notifying drivers of these accident-prone locations, drivers may be more cautious and/or defensive when driving in such areas.

As shown in FIG. 1, the exemplary system of the present invention includes application server 101 in communication with database server 102. Database server 102 is in communication with accident database 103. In some embodiments, application server 101 may also communicate with accident database 103.

In the exemplary embodiment of FIG. 1, application server 101 is in communication with database server 102. Application server 101 communicates requests for information to database server 102. Database server 102 retrieves the requested information. Application server 101 may also send information to database server 102 for storage in accident database 103. Application server 101 is also in communication with client devices 104, 105, and 106 over communication network 107. Application server 101 delivers software applications to client devices 104, 105, and 106. Communication network 107 may be an internal network, such as a local area network (LAN), a wide area network (WAN), such as the internet, wireless networks (WiFi), cellular networks, satellite communication network, or any combination thereof.

Figure 2:
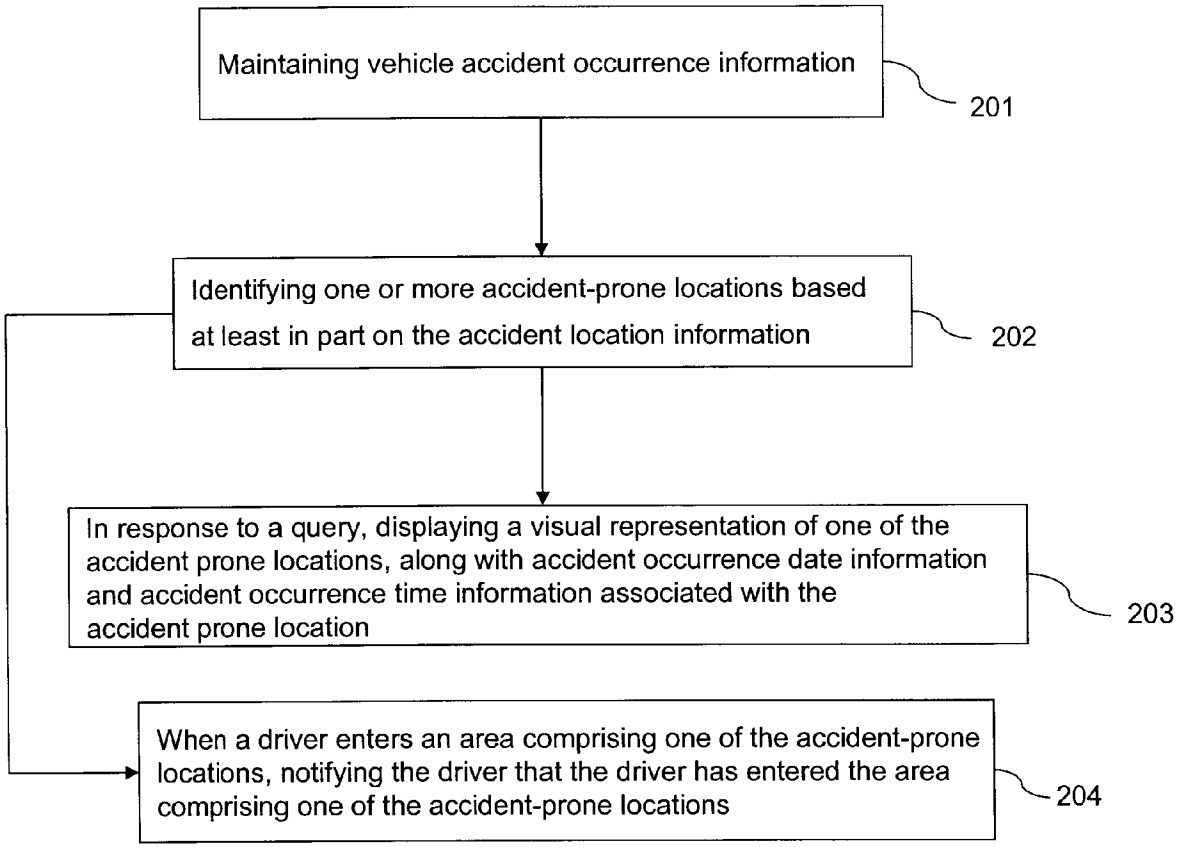
FIG. 2 is a flowchart illustrating an exemplary workflow in accordance with the present invention.

FIG. 2 is a flowchart illustrating an exemplary workflow in accordance with the present invention. At step 201, accident occurrence information is maintained. Accident database 103 stores information regarding the occurrence of automobile accidents. For example, accident database 103 may store basic accident occurrence data, such as accident location data, accident occurrence data information (i.e., day of the week of the accident occurred), and accident occurrence time information (i.e., the time of day the accident occurred). Accident location data may include street/cross street, address, and latitude/longitude coordinates. Accident database 103 may also store additional accident occurrence information, such as the number of vehicles involved in the accident (e.g., single vehicle, two vehicles, or more than two vehicles), the direction of travel of the vehicle cited as causing the accident, the direction of travel of other vehicles involved, the age of the driver cited as causing the accident, the age of other drivers involved, the weather conditions, whether an alcohol related violation was involved in the accident, whether the accident was speeding related, whether the accident involved a pedestrian, whether the accident involved fatalities, or whether the accident involved injuries.

Accident database 103 may be a relational database; however, other data organizational structures may be used without departing from the scope of the present invention. Database server 102 may include a database services management application that manages storage and retrieval of information from database 103. Database server 102 additionally may communicate with any other information supplier to retrieve information. For example, database server 102 may retrieve information to store in database 103 from insurance companies or local, state, or federal governments (e.g., the Department of Transportation).

As shown in FIG. 1, client devices 104, 105, and 106 may be computer workstations, portable computers, personal computers, handheld devices, such as personal digital assistants, cellular phones, mobile internet devices (MIDs), or the like. In addition, client devices 104, 105, and 106 may include any other device, such as a "dumb terminal" dedicated to communication and display of information only, that is convenient for receiving notification of accident zones. Client devices 104, 105, and 106 may be wired into the communication network 107 or may be wireless.

Client devices 104, 105, and 106 shown in FIG. 1 may include a web browser or other graphical user interface as well as other computer applications. Examples of various interfaces are shown in FIGS. 3-6. When data or a particular application is requested by client devices 104, 105, and 106 through an application, such as a web browser, the application server 101 receives and processes the request. The application server 101 sends the data or application requested to the client along with user interface instructions for displaying a user interface on client devices 104, 105, and 106.

One or more accident-prone locations are identified based at least in part on the accident location information (step 202). In one embodiment, application server 101 may identify accident-prone locations (i.e., accident zones). Application server 101 may identify the accident-prone locations based on any one or a combination of accident location information, accident occurrence date information, or accident occurrence time information. Application server 101 transmits a request or query for information, such as accident location information, accident occurrence date information, or accident occurrence time information, to database server 102. Database server 102 processes the request or query and retrieves the information from accident database 103. Database server 102 transmits the retrieved information to application server 101.

Application server 101 processes the retrieved information. For example, application server 101 may process the information to identify the accident-prone locations. Application server 101 may analyze the accident location information to determine locations having a high frequency, a medium frequency and a low frequency of accidents. Various thresholds may be used to define a frequency of accidents (e.g., greater than five accidents in a particular location in a year may be considered high frequency; between two and five, a medium frequency, and less than two a low frequency). Other criteria may be used in addition to or in lieu of the number of accidents, e.g., the number of injuries or the number of fatalities.

Application server 101 may also analyze the accident location information as well as the accident occurrence date information or accident occurrence time information to determine locations having a high frequency and medium frequency of accidents (e.g., greater than ten accidents on Mondays between 6 A.M. and 9 A.M.) and to determine the severity of the accidents (e.g., high, medium, or low). Application server 101 may store the identified accident-prone locations in memory or other form of data storage, such as a database, on application server 101 or in accident database 103.

In another embodiment, database server 102 identifies accident-prone locations (i.e., accident zones) and transmits the accident-prone locations to application server 101. For example, database server 102 queries accident database 103 for information, such as accident location information, accident occurrence date information, or accident occurrence time information. Database server 102 processes the retrieved information. For example, database server 102 may process the information to identify the accident-prone locations as described above. Database server 102 may then transmit the identified accident-prone locations to application server 101 for storage in memory or other form of data storage, such as a database, on application server 101. In addition, database server 102 stores the identified accident-prone locations in accident database 103.

Figure 5:
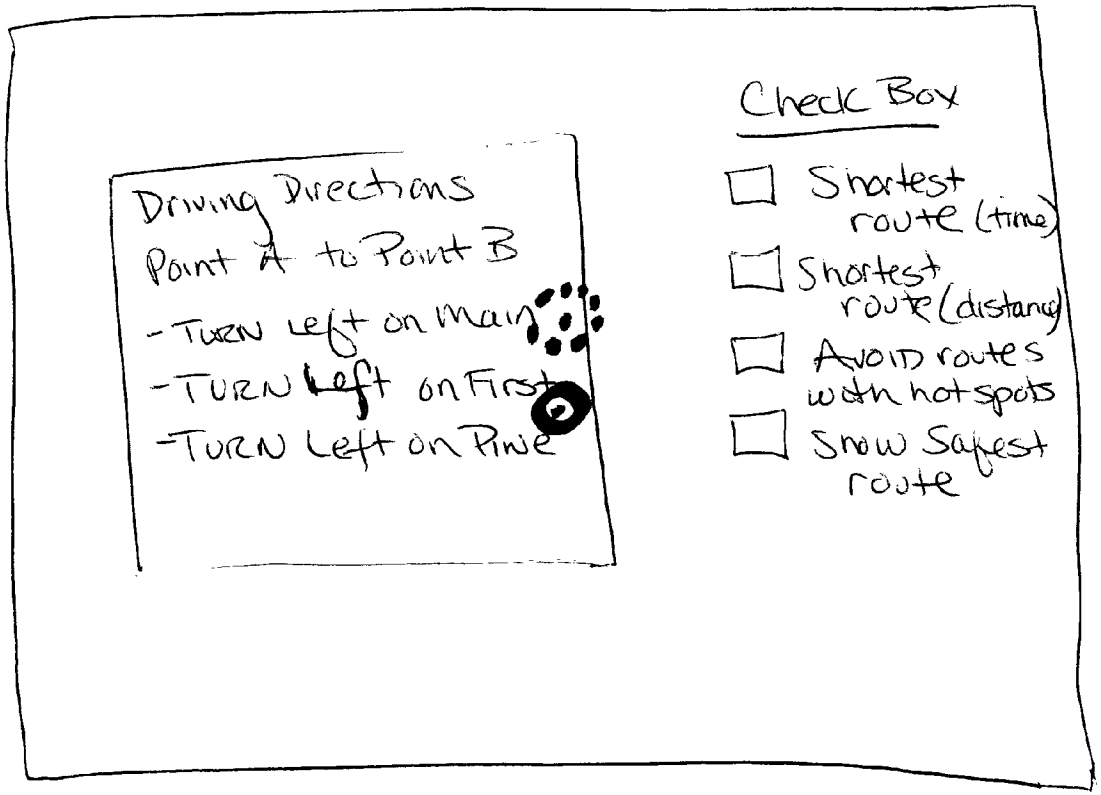

Client devices 104, 105, and 106 shown in FIG. 1 may access and request or query accident database 103 over communication network 107 to retrieve accident-prone location or "hot spot" information identified by application server 101 or database server 102. Client devices 104, 105, and 106 may query database 103 based on zip codes, street/cross street, street address, age of drivers involved, time of day, or day of the week. Other search criteria may also be used to search database 103. In some embodiments, client devices 104, 105, and 106 may display a mapping tool to receive a street address from a user. In other embodiments, the client devices 104, 105, and 106 may receive a request for driving directions between two locations. FIG. 5 illustrates an example. The client devices 104, 105, and 106 may also receive a selection by a user of whether the user desires to avoid routes having accident hot spots or whether the user desires to be showed the safest route as shown in FIG. 6.

In some embodiments, database server 102 receives the search criteria from application server 101, queries database 103 for accident-prone locations based on the search criteria, and transmits the accident-prone locations to application server 101 Application server 101 processes the accident-prone locations for transmission and display on client devices 104, 105, and 106. For example, application server 101 may process the accident-prone location information for display on a map on client devices 104, 105, and 106. The accident-prone location information, accident occurrence data information, accident occurrence time information, and map information may be transmitted to client devices 104, 105, and 106 for display. In other embodiments, the accident-prone locations may be displayed without use of a map.

Figure 3:
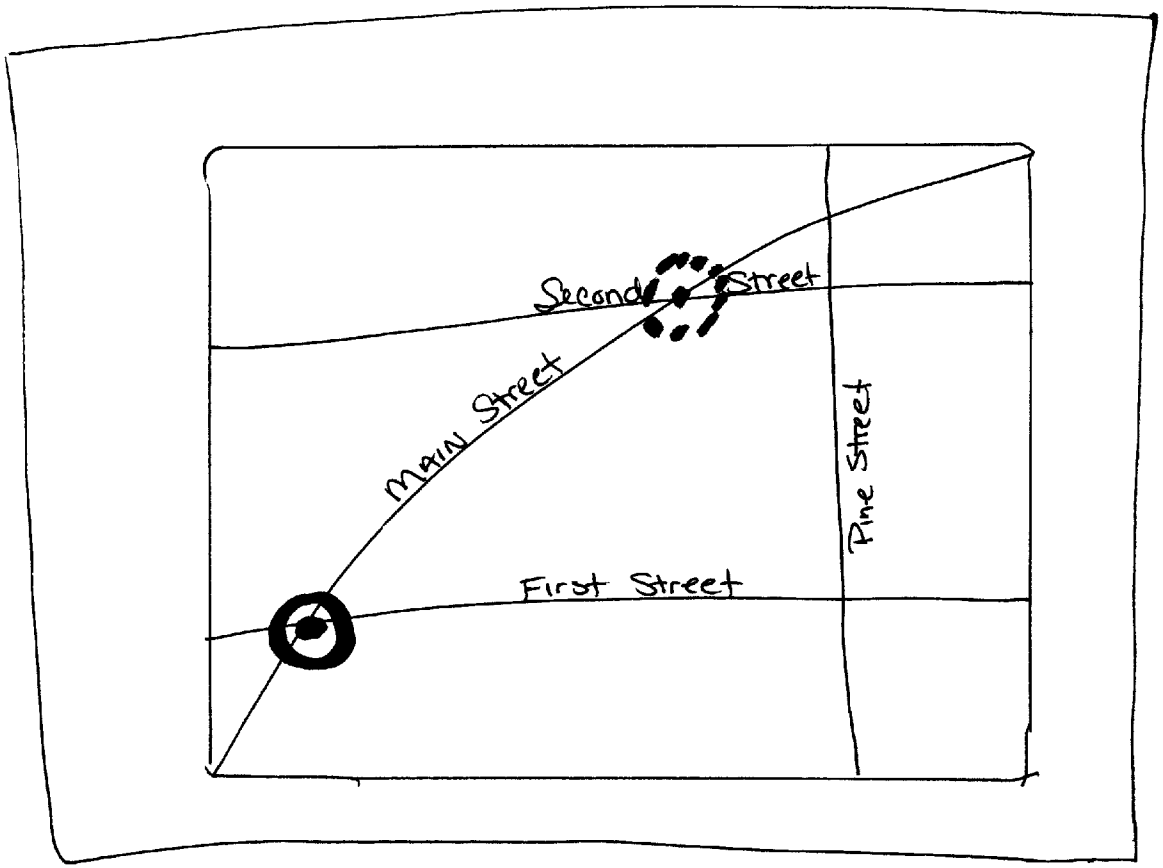
FIGS. 3-6 illustrate exemplary graphical user interfaces in accordance with the present invention.
Figure 4:
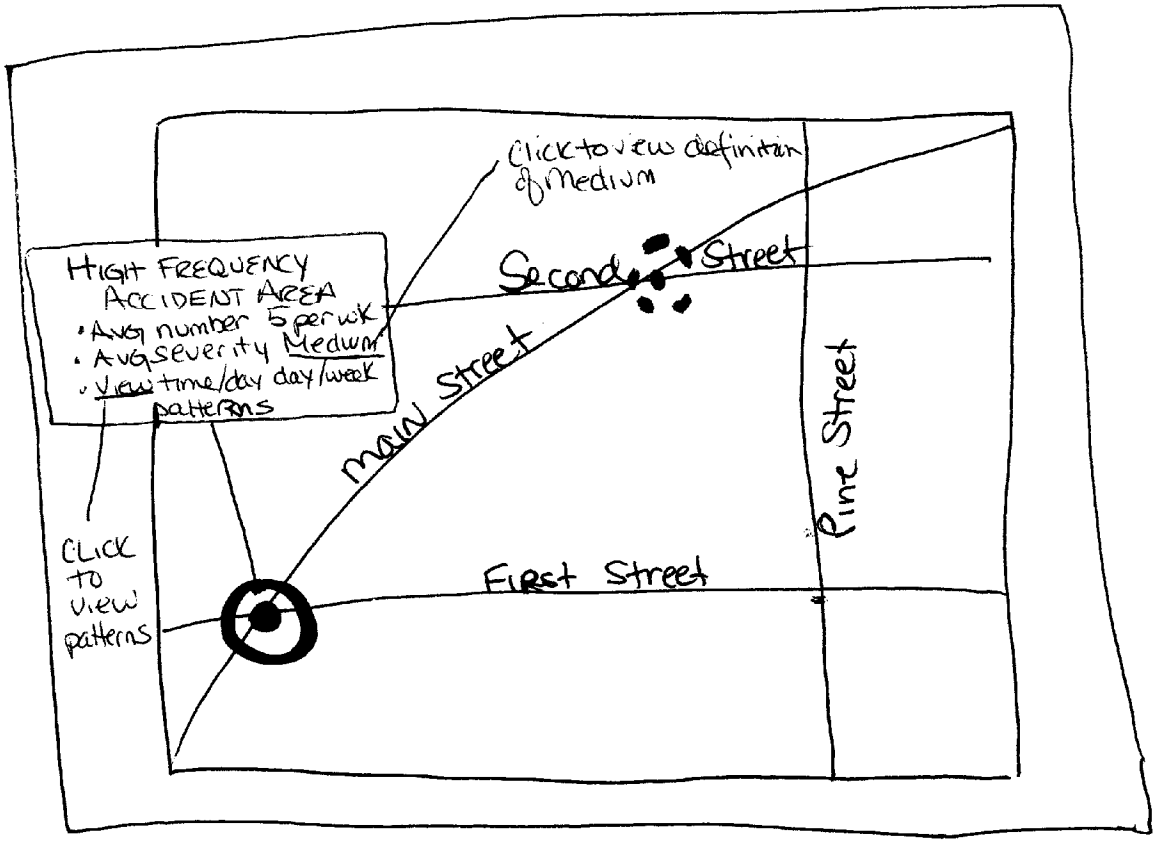

In some embodiments, client devices 104, 105, and 106 display a graphical or visual representation of the map showing the hot spots or accident-prone locations (step 203). In addition, accident occurrence date information and accident occurrence time information associated with the accident-prone locations may be displayed (step 203). FIGS. 3-6 are examples of the maps that may be displayed. For example, the graphical or visual representation may show red shading for high frequency accident areas matching the search criteria and yellow shading for accident areas having a lower frequency of accidents. FIGS. 3-4 illustrate examples of the use of various bulls-eye symbols in red and yellow indicating high frequency and medium frequency hotspots. Hot spots on the map may be clickable by the user to view more details about the nature of the accidents that have happened in the area. (See FIG. 4.) By clicking on the red bulls-eye, the details regarding a particular high frequency accident area may be viewed. The frequency, severity, and accident occurrence patterns may be displayed.

Figure 6:
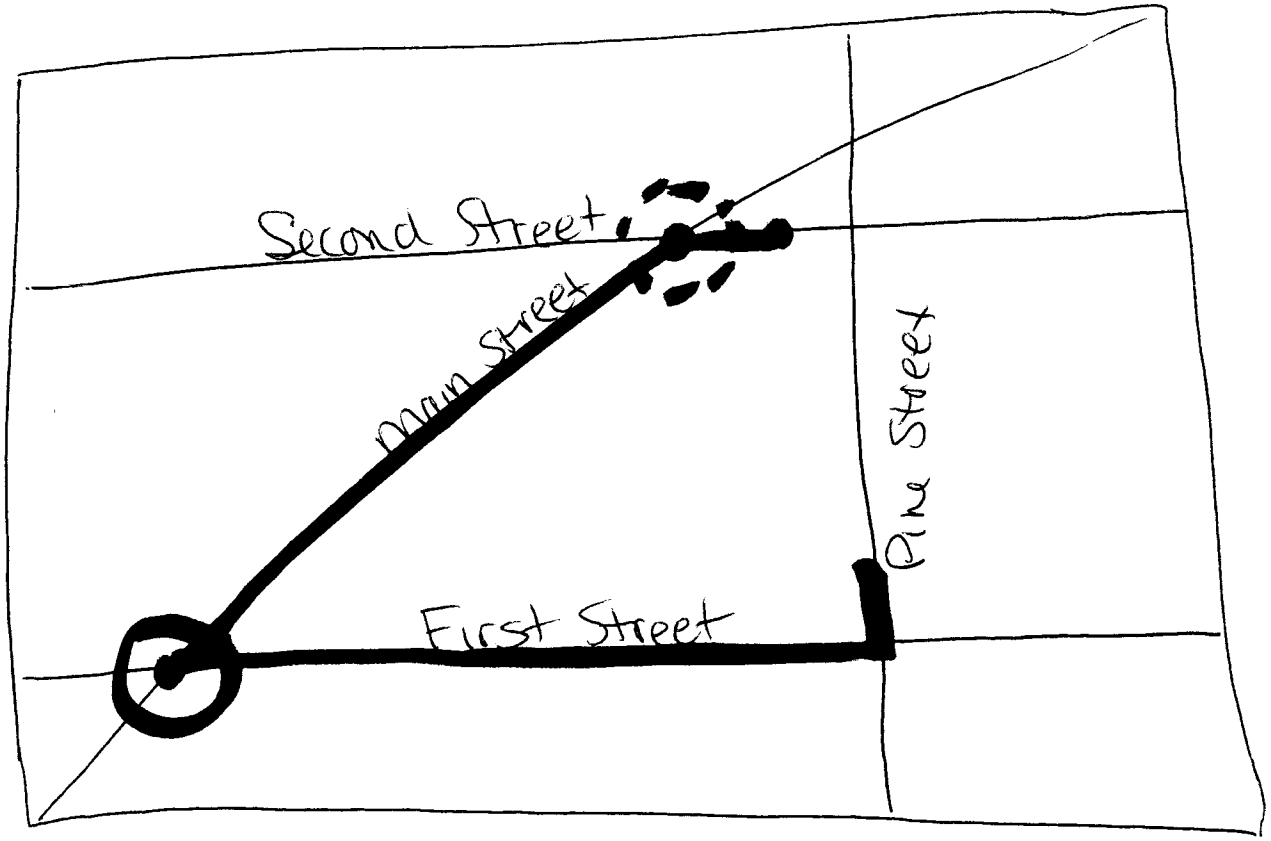

FIGS. 5 and 6 illustrate interfaces displayed when a user requests driving directions. For example, in FIG. 5, directions may be displayed showing bulls-eyes indicated high frequency and medium frequency accident-prone locations. The directions may be based on avoiding routes with accident hot spots and showing the safest routes. FIG. 6 illustrates an interface showing a driving route and displays bulls-eyes indicating accident-prone locations.

Figure 7:
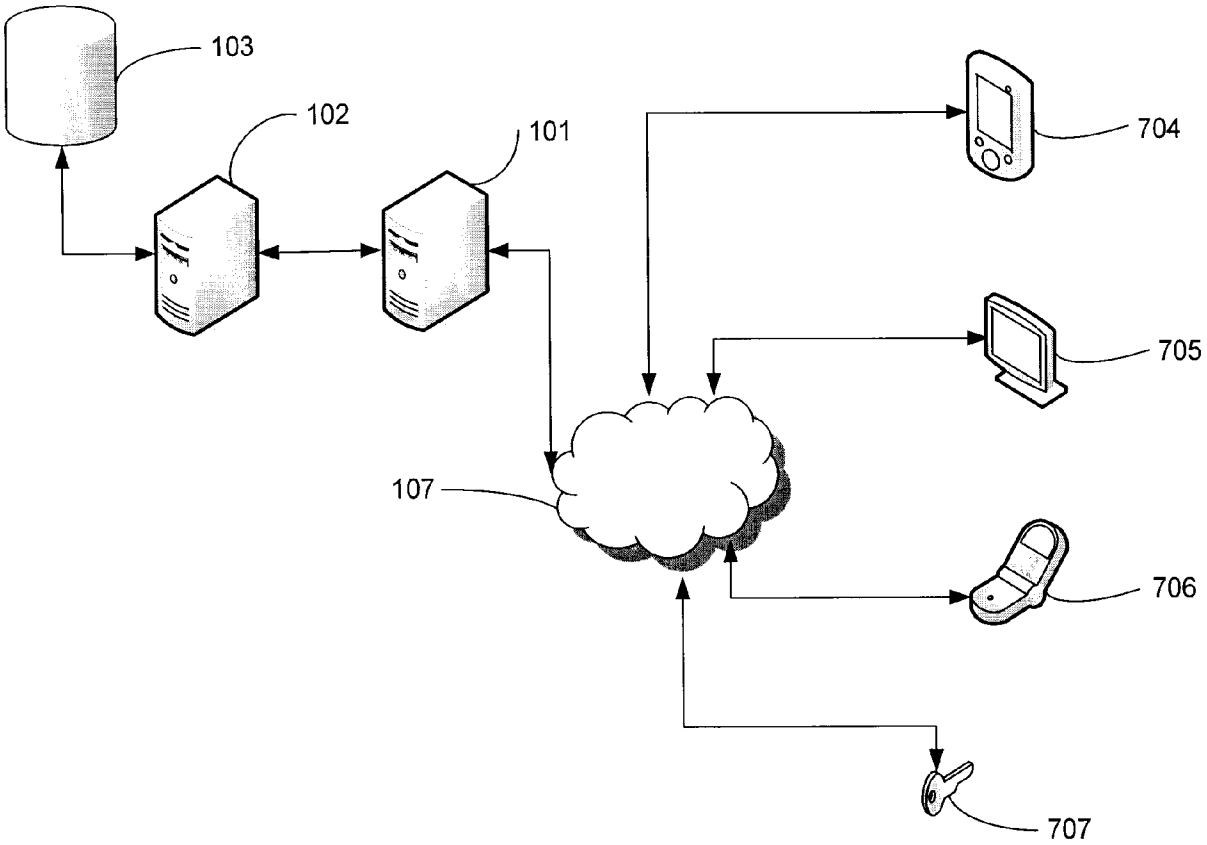
FIG. 7 is a system diagram illustrating another exemplary embodiment of the present invention.

FIG. 7 is a system diagram illustrating another exemplary embodiment of the present invention. In FIG. 7, the exemplary system of the present invention includes application server 101 in communication with database server 102. Database server 102 is in communication with accident database 103. In some embodiments, application server 101 may also communicate with accident database 103.

Application server 101 is also in communication with client devices 704, 705, 706, and 707 over communication network 107. Client devices 704, 705, 706, and 707 shown in FIG. 7 are Global Positioning System (GPS) enabled devices, such as GPS devices permanently installed in a vehicle, portable GPS devices, GPS enabled mobile telephones, mobile internet devices (MIDs), or other GPS enabled portable devices. Client devices 704, 705, 706, and 707 are GPS receivers, which calculate or determine any combination of their location, speed, direction, and time using GPS satellites. Client devices 704, 705, 706, and 707 may also be two-way GPS devices. Client devices 704, 705, 706, and 707 include GPS mapping software for mapping, navigation or route planning (mapping, navigation, route planning would not be relevant to all of these devices, such as key ring/fobs). They process any combination of the location, speed, direction, and time information received and may display the information using the GPS mapping software as latitude, longitude, and/or altitude or location on a map.

Client devices 704, 705, 706, and 707 transmit the location, speed, direction, and time information to application server 101 over communication network 107. The information may be transmitted as latitude, longitude, and/or altitude or location information to application server 101. For example, client devices 704, 705, 706, and 707 may connect via cellular network or wireless network to application server 101 to transmit the information in real-time.

Application server 101 processes the information and queries accident database 103 based on the information to retrieve accident-prone locations, accident occurrence data information, and/or accident occurrence time information. Application server 101 transmits accident-prone locations, accident occurrence data information, and/or accident occurrence time information to client devices 704, 705, 706, and 707.

In still other embodiments, client devices 704, 705, 706 and 707 maintain an application and memory on the device itself. In such an embodiment, the device 704, 705, 706 or 707 maintains hotspot location data downloaded to it from application server 101. Such downloads may be periodic and automatic and/or may be user-initiated. In order to minimize the volume of data to be stored on the device, the user may choose to download only that data that is pertinent to the user (e.g., data along a commuting or other travel route of interest). The application downloaded to the device will allow the device to determine, based on such downloaded data, when the device is entering/leaving a hotspot location and generate a notification of the same. Updated versions of the application may be downloaded to the device as enhancements are made.

Client devices 704, 705, 706, and 707 notify the user, such as a driver, of the accident-prone locations (step 204). For example, when a user, such as a driver, enters a location or area that is an accident-prone location, the user is notified through client devices 704, 705, 706, and 707. Client devices 704, 705, 706, and 707 may issue audible and/or visual notifications when the devices have entered and when the devices leave a "hot spot." The visual notifications may include the use of bulls-eyes as described above, which show high frequency and medium frequency accident-prone locations. These visual notifications are super-imposed over the maps displayed on the GPS devices. The audible notifications may be changed and customized by the device user. Thus, such audible notifications may include stock/standard audible notifications on the device, as well as the ability to apply user-specified customized tones (e.g., ringtones, music snippets, voice snippets, etc) downloaded from a website or sourced from a user-owned source (i.e., personal voice recording, music from a compact disc).

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

What is claimed is:

1. A method comprising:

maintaining vehicle accident occurrence information, wherein the accident occurrence information comprises accident location information;

identifying, based at least in part on the accident location information, one or more accident-prone locations; and when a vehicle enters an area comprising one of the accident-prone locations, providing a visual indicator and an audible indicator on a GPS enabled device that the vehicle has entered the area comprising one of the accident-prone locations, the visual indicator being superimposed on a map and being configured to indicate visually, without text, both of a frequency and a severity of accidents previously occurring at the accident-prone locations; the GPS enabled device being separate from and not connected, either physically or electronically, to the vehicle.

2. A system comprising:

a database that maintains vehicle accident occurrence information comprising accident location information;

a processor that identifies one or more accident-prone locations based, at least in part, on the accident location information; and a notification component comprising a GPS enabled device that provides a visual indicator that a vehicle has entered an area comprising one of the accident-prone locations when the vehicle enters the area comprising one of the accident-prone locations, the visual indicator being superimposed on a map and being configured to indicate visually, without text, both of a frequency and a severity of accidents previously occurring at the accident-prone locations; the GPS enabled device being separate from and not connected, either physically or electronically, to the vehicle.

3. A method comprising:

maintaining vehicle accident occurrence information, wherein the vehicle accident occurrence information comprises accident location information, accident occurrence date information, and accident occurrence time information;

identifying, based at least in part on the accident location information, one or more accident-prone locations; and in response to a user-initiated query, the query comprising a request to identify accident-prone locations, displaying on a display component a visual representation of one or more of the accident-prone locations, wherein the visual representation is displayed by way of an indicator superimposed on a map, and wherein information describing accident occurrence date, accident occurrence time, a number of vehicles involved in the accident, a direction of travel of a vehicle involved in the accident, an age of a driver involved in the accident, weather conditions at the time of the accident, speed of vehicles involved in the accident, and injuries or fatalities sustained as a result of the accident, associated with the one or more accident-prone location is displayed upon selecting the indicator.

4. A system comprising:

a database that maintains vehicle accident occurrence information, wherein the vehicle accident occurrence information comprises accident location information, accident occurrence date information, and accident occurrence time information;

a processor that identifies one or more accident-prone locations based, at least in part, on the accident location information; and a display component that displays, in response to a user-initiated query, the query comprising a request to identify accident-prone locations, a visual representation of one or more of the accident-prone locations, wherein the visual representation is displayed by way of an indicator superimposed on a map, and wherein information describing accident occurrence date, accident occurrence time, a number of vehicles involved in the accident, a direction of travel of a vehicle involved in the accident, an age of a driver involved in the accident, weather conditions at the time of the accident, speed of vehicles involved in the accident, and injuries or fatalities sustained as a result of the accident, associated with the one or more accident-prone location is displayed upon selecting the indicator.

5. A method for delivering vehicle accident occurrence information, comprising:

maintaining vehicle accident occurrence information, wherein the vehicle accident occurrence information comprises accident location information;

identifying, based at least in part on the accident location information, one or more accident-prone locations; and in response to a query, initiated by a user in a non-driving context, the query comprising a request to identify accident-prone locations within an area on a map, displaying on a display component separate from and not connected to a vehicle a visual representation of one or more of the accident-prone locations wherein the visual representation is displayed by way of an indicator superimposed on the map, the indicator being configured to indicate visually, without text, both of a frequency and a severity of accidents previously occurring at the accident-prone locations.

6. A system for delivering vehicle accidence occurrence information, comprising:

a database that maintains vehicle accident occurrence information, wherein the vehicle accident occurrence information comprises accident location information;

a processor that identifies one or more accident-prone locations based, at least in part, on the accident location information; and a display component separate from and not connected to a vehicle that displays, in response to a query, initiated by a user in a non-driving context, the query comprising a request to identify accident-prone locations within an area on a map, a visual representation of one or more of the accident-prone locations wherein the visual representation is displayed by way of an indicator superimposed on the map, the indicator being configured to indicate visually, without text, both of a frequency and a severity of accidents previously occurring at the accident-prone locations.

* * * * *